United States Patent [19]

Todd et al.

[11] Patent Number: 4,838,967

[45] Date of Patent: Jun. 13, 1989

[54] BABY'S BATH

[76] Inventors: Vern L. Todd; James Edye, both of 49 John Street, Woollahra, New South Wales, 2025, Australia

[21] Appl. No.: 844,343

[22] Filed: Oct. 21, 1977

Related U.S. Application Data

[60] Continuation of Ser. No. 676,761, Apr. 14, 1976, abandoned, which is a division of Ser. No. 540,927, Jan. 14, 1975, abandoned, which is a continuation-in-part of Ser. No. 297,149, Oct. 12, 1972, abandoned.

[30] Foreign Application Priority Data

Oct. 15, 1971 [AU] Australia ..... 6667

[51] Int. Cl.[4] ..... B32B 31/26

[52] U.S. Cl. ..... 156/145; 4/585; 4/586; 4/588; 4/DIG. 8; 156/292; 264/519; 264/524; 264/528; 264/572

[58] Field of Search ..... 4/1, 112, 113, 173, 4/177, 185 B, 185 HB, DIG. 8, 185 AB; 156/145, 146, 147, 292; 264/96, 519, 524, 528, 572

[56] References Cited

U.S. PATENT DOCUMENTS

| | | | |
|---|---|---|---|
| 1,493,729 | 5/1924 | Brown | 4/DIG. 8 |
| 1,644,402 | 10/1927 | Rosswinkle | 4/185.5 |
| 2,515,064 | 7/1950 | Tritt et al. | 264/96 |
| 2,564,656 | 8/1951 | Chedister | 156/145 |
| 3,409,917 | 11/1968 | Howard | 4/177 |
| 3,418,663 | 12/1968 | Scott | 4/113 |
| 3,709,967 | 1/1973 | Held | 264/96 |
| 3,755,828 | 9/1973 | Sattler | 4/113 |

FOREIGN PATENT DOCUMENTS 238417 8/1925 United Kingdom .

*Primary Examiner*—Caleb Weston
*Attorney, Agent, or Firm*—Ladas & Parry

[57] ABSTRACT

This invention is concerned with inflatable plastic baby baths similar in shape to a rubber tire inner tube having an impervious web across the ring. The web is preferably midway between the top and the bottom of the inflatable tube or annulus, and by inflating the article while hot during manufacture a smooth and wrinkle-free appearance can be produced. Such a plastic bath can be made virtually immovable on a smooth surface by expelling air from under the web and causing a partial vacuum. The diameter of the inflated tube is sufficiently great relative to the width of the web to prevent the web touching the supporting surface in normal use.

2 Claims, 1 Drawing Sheet

BABY'S BATH

This is a continuation of co-pending Application Ser. No. 676,761 filed 4-14-76 now abandoned, which is itself a divisional of Application Ser. No. 540,927 filed Jan. 14 1975, now abandoned, which is itself a continuation-in-part of Application Ser. No. 297,149 filed Oct. 12 1972, now abandoned.

This invention relates to an inflatable bath and in particular inflatable baths suitable for bathing human infants.

Conventional baby's baths have been constructed of a relatively rigid material such as stiff plastics material or metal. As is well known babies in their first months of life are very delicate and must be handled with great care to avoid bodily damage. The use of a bath made of a rigid material could cause damage to a baby if the baby slipped from the hands of a person washing it. Conventional baby's baths suffer from the further disadvantage that they are generally of a deep construction and require up to 2 gallons of water to wash a baby adequately. The present invention is designed to provide a bath of a soft, flexible nature so as to avoid the possibility of a baby being injured while bathing and a bath in which less water is used than would normally be required.

In accordance with the invention an oval shaped bath is provided comprising a single inflatable tubular annulus and an unpadded impervious web across an aperture described by the annulus, the diameter of the tube of the said annulus when inflated being sufficient to prevent the web touching a plane surface supporting the bath, said web extending across the aperture formed by the annulus at a position midway through the thickness of the annulus when inflated, the said bath also being substantially wrinkle-free.

The bath is of particular use in hospitals as a bath that has been sterilised can be used for the washing of two babies, i.e. one on each side of the web, whereas conventional baths must be sterilised after each baby is washed.

Preferred embodiments of the invention have the further advantage that on smooth surfaces on which a conventional bath may tend to slip the air space under the web acts as a suction cup when air is displaced from the space. The bath is thereby clamped to the surface, thus preventing the possibility of the bath slipping off the surface if it is inadvertently knocked.

The bath is preferably made from sheets of polyvinyl chloride, however any other flexible, air impermeable sheet material may be used. A preferred method of forming a bath according to this invention comprised the following steps:

1. Mark out the shape of the bath on a sheet of suitable material.
2. Cut out a valve aperture and welding a valve in position.
3. Weld or glue the edges of the marked out shape using two superposed sheets of the material and trim off excess material.
4. Heat the material preferably by inserting it into boiling water for a short period of time, inflate the bath with air while it is still hot and allow it to cool while still inflated.

If desired the steps 1 and 3 could be combined by using e.g. a heating die of an appropriate size and shape. It has been found that if step 4 is not carried out the bath on subsequent inflation by the consumer partially distorts by the the appearance of wrinkles along the circumference of the annulus, particularly in the vicinity of the seams. These wrinkles tend to destroy the ability of the bath to rigidly suck onto the surface on which it is being used.

In the case of PVC, the step of inflating the bath when hot during manufacture imparts a "memory" into the material, thus causing it to reassume its smooth wrinklefree shape on subsequent inflations.

Hereinafter given by way of example only is a preferred embodiment of the present invention described with reference to the accompanying drawings in which.

Figure 1:
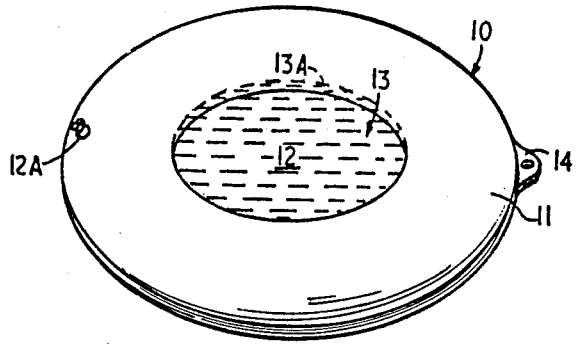
FIG. 1 is a plan view of a baby's bath according to this invention.
Figure 2:
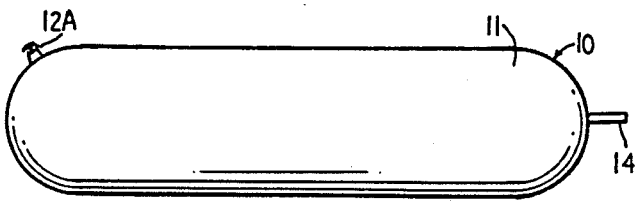
FIG. 2 is a side elevation of the bath of FIG. 1.
Figure 3:
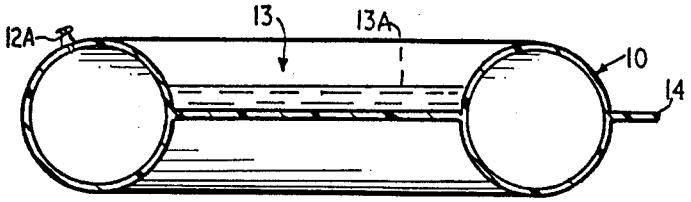
FIG. 3 is a longitudinal sectional view of the bath of FIG. 1.

The bath 10 comprises an annular tube 11 of substantially oval shape and of circular cross sectional configuration. The tube is provided with a valve 12A for the inlet and outlet of air to inflate or deflate the tubed 11. The valve is positioned so as not to interfere with the occupant of the bath or the bather. A web of material 12 extends across the aperture defined by the annular tube 11 midway through the thickness of the tube 11.

The bath 10 is so dimensioned that it can be used to wash babies up to 6 months old after which time the bath may be used as a bassinet, crib, drying bed or the like. In use the bath is provided with a small quantity of water 13A in the depression 13 defined by the annular tube and the web, a baby can then be placed face up in the depression and washed. The soft nature of the bath, which is made of PVC material, and the flexible nature of the air filled tube ensure that the baby will not be hurt or injured by striking the sides of the bath. The rounded and flexible walls of the bath prevent the baby from moving about in the bath unduly and prevent it from rolling over into the water if left unattended for a short period. The shape of the preferred embodiment of the invention is designed to allow the baby's feet to touch the wall of the bath as this has been found to provide the baby with a sense of security when it is being washed. A tab 14 may be provided to facilitate storage, for example by hanging the tub on a wall.

Figure 4:
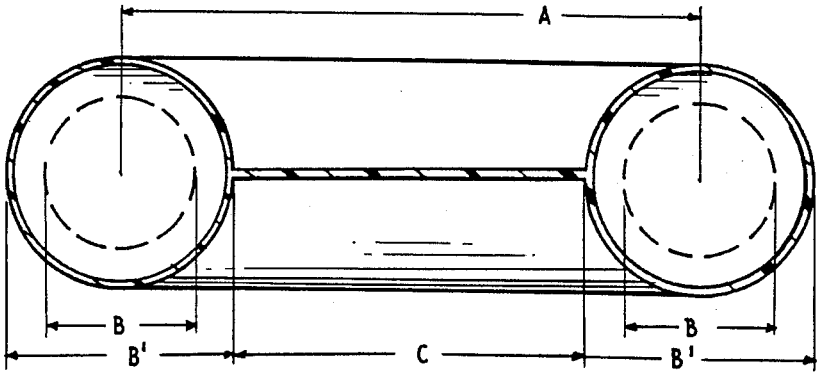
FIG. 4 is a cross sectional view of the bath of FIG. 1.

The dimensions of the bath of the present invention are significant. With reference to FIG. 4, A is the constant distance between the annulus, B is the diameter of the annulus under moderate inflation. $B^1$ is the diameter of the annulus fully inflated and C is the width of the web. It has been found that if the web is made in width equal to $C-A-B$ or $A-B^1$, the web becomes slack in use and sags downward thus defeating the safety aspect of the bath. In this invention, this disadvantage has been overcome by making the width of the web $C<A-B^1$, that is, smaller than the minimum of the variable space formed by the inside face of the inflated annulus. Thus, for optimum performance $B^1>A-C$ or $C<A-B^1$.

The bath may be used on persons other than human infants. For example, by manufacturing a bath 5' long by the same general principle described above, a bath may be used to wash invalids, paraplegics and the like. In some cases, it is envisaged the bath portion when clamped to another surface, may be used to support and assist incapacitated persons for prolonged periods.

The bath according to the invention can conveniently be made by marking out on a sheet of PVC material, preferably of a thickness of 0.014", the desired shape of the bath and at some suitable position inserting a valve to allow the bath to be inflated and deflated. The sheet is then superposed on a further sheet of the same material, of the same or a different colour and the sheets are heat welded together along the outline marked on the upper sheet to form a central web zone and an annular tubular zone. It is important that during manufacture the longitudinal axis of the outline of the bath run in the longitudinal direction of the supply of PVC material, as the PVC possesses stretch characteristics in a longitudinal direction that are favourable to producing a wrinkle-free article.

The sheets are then trimmed to the outer shape of the tubular zone and the bath is immersed in boiling water for 5 seconds and inflated with air. On cooling it is found that the inflated tubular zone assumes a smooth outer shape without the wrinkles which would be present if the bath was merely inflated without being heated. It will be appreciated that the process of heating and inflating articles of thermoplastic sheet material produce a wrinkle-free article and has a general application outside the specific process of the manufacture of baby's baths.

Numerous modifications to the preferred embodiment described above may be made within the broad scope of the invention as hereinbefore defined.

What we claim is:

1. A method of manufacturing an inflatable bath comprising the steps of providing a first thickness of flexible, polyvinyl chloride air-impermeable sheet material with a valve, and sealing a second thickness of flexible, polyvinyl chloride air-impermeable sheet material to said first thickness along first and second closed paths, said first path lying wholly within the second path and the valve lying between the first and second paths, thereby to form an inflatable annulus of substantially uniform cross section between said first and second paths and a web within the annulus, and the method also comprising heating the bath while uninflated by contact with a hot fluid, removing the uninflated bath from contact with the hot fluid, inflating the bath while it is hot and allowing the bath to cool while inflated to provide an article which is smooth and wrinkle-free on subsequent reflation.

2. A method as claimed in claim 1, wherein the fluid is water.

* * * * *